US009828656B2

(12) United States Patent
Itoh et al.

(10) Patent No.: US 9,828,656 B2
(45) Date of Patent: Nov. 28, 2017

(54) NI-BASE ALLOY

(71) Applicants: MITSUBISHI MATERIALS CORPORATION, Tokyo (JP); Hitachi Metals MMC Superalloy, Ltd., Okegawa-shi (JP)

(72) Inventors: Masato Itoh, Okegawa (JP); Kenichi Yaguchi, Okegawa (JP); Tadashi Fukuda, Kitamoto (JP); Takanori Matsui, Kitamoto (JP)

(73) Assignee: Hitachi Metals MMC Superalloy, Ltd., Okegawa-shi (JP)

( * ) Notice: Subject to any disclaimer, the term of this patent is extended or adjusted under 35 U.S.C. 154(b) by 465 days.

(21) Appl. No.: 14/375,581

(22) PCT Filed: Feb. 6, 2013

(86) PCT No.: PCT/JP2013/052683

§ 371 (c)(1),
(2) Date: Jul. 30, 2014

(87) PCT Pub. No.: WO2013/118750

PCT Pub. Date: Aug. 15, 2013

(65) Prior Publication Data

US 2015/0010427 A1 Jan. 8, 2015

(30) Foreign Application Priority Data

Feb. 7, 2012 (JP) ..... 2012-024294

(51) Int. Cl.
*C22C 19/05* (2006.01)
*C22F 1/10* (2006.01)

(52) U.S. Cl.
CPC ..... *C22C 19/056* (2013.01); *C22C 19/055* (2013.01); *C22F 1/10* (2013.01); *F05C 2201/0466* (2013.01)

(58) Field of Classification Search
CPC ..... C22C 19/056; C22C 19/055; C22F 1/10
See application file for complete search history.

(56) References Cited

U.S. PATENT DOCUMENTS 3,825,420 A * 7/1974 Ewing et al. ..... C22C 1/0433 148/428
4,612,062 A 9/1986 Nazmy et al.
(Continued)

FOREIGN PATENT DOCUMENTS

EP 1293583 A 3/2003
JP 59-118826 A 7/1984
(Continued)

OTHER PUBLICATIONS

International Search Report dated Mar. 12, 2013 for the corresponding PCT Application No. PCT/JP2013/052683.
(Continued)

*Primary Examiner* — Jessee Roe
(74) *Attorney, Agent, or Firm* — Leason Ellis LLP

(57) ABSTRACT

In a Ni-base alloy, an area-equivalent diameter D is calculated. D is defined by $D=A^{1/2}$ from an area A of a largest nitride in a field of view when an observation area $S_0$ is observed. This process is repeated in n fields of view for measurement, where n is the number of the fields of view for measurement, so as to acquire n pieces of data on D, and the pieces are arranged in ascending order $D_1, D_2, \ldots, D_n$ to obtain a reduced variate $y_j$. The obtained values are plotted on X-Y axis coordinates, where an X axis corresponds to D and a Y axis corresponds to $y_j$. In a regression line $y_j=a\times D+b$, $y_j$ is obtained when a target cross-sectional area S is set to 100 $mm^2$. When the obtained $y_j$ is substituted into the regression line, the estimated nitride maximum size is ≤25 μm in diameter.

2 Claims, 2 Drawing Sheets

(56) References Cited

U.S. PATENT DOCUMENTS

| | | | |
|---|---|---|---|
| 4,629,521 | A | 12/1986 | Maurer et al. |
| 4,810,466 | A | 3/1989 | Choi et al. |

FOREIGN PATENT DOCUMENTS

| | | | |
|---|---|---|---|
| JP | 61-139633 | A | 6/1986 |
| JP | 62-158844 | A | 7/1987 |
| JP | 63-137134 | A | 6/1988 |
| JP | 2002-322548 | A | 11/2002 |
| JP | 2005-285544 | A | 9/2005 |
| JP | 2005-274401 | A | 10/2005 |
| JP | 2006-118016 | A | 5/2006 |
| JP | 2007-009279 | A | 1/2007 |
| JP | 2009-185352 | A | 8/2009 |

OTHER PUBLICATIONS

Office Action dated May 14, 2013 for the corresponding Japanese Application No. 2012-024294.

Extended European Search Report dated Sep. 9, 2015 for the corresponding European Application No. 13746952.4.

Alexandre et al., "Modelling the optimum grain size on the low cycle fatigue life of a Ni based superalloy in the presence of two possible crack initiation sites", *Scripta Materialia, Elsevier*, Jan. 1, 2004, pp. 25-30 vol. 50, No. 1, Amsterdam, NL.

Summons to Attend Oral Proceedings dated Apr. 11, 2017 for the corresponding European Patent Application No. 13746952.4.

* cited by examiner

NI-BASE ALLOY

CROSS-REFERENCE TO RELATED APPLICATION

This is the U.S. National Phase Application under 35 U.S.C. §371 of International Patent Application No. PCT/JP2013/052683 filed Feb. 6, 2013, which designated the United States and claims the benefit of Japanese Patent Application No. 2012-024294 filed on Feb. 7, 2012, both of which are incorporated by reference in their entirety herein. The International Application was published in Japanese on Aug. 15, 2013 as WO/2013/118750 under PCT Article 21(2).

FIELD OF THE INVENTION

The present invention relates to a Ni-base alloy which is used in blades, vanes, rings, combustion chambers, and the like of aircrafts and gas turbines and is excellent in mechanical properties, especially, fatigue strength.

BACKGROUND OF THE INVENTION

Hitherto, for example, as shown in Japanese Unexamined Patent Application, First Publication Nos. S61-139633 and 2009-185352, a Ni-base alloy has been widely applied as a material of parts which are used in aircrafts, gas turbines, and the like.

Japanese Unexamined Patent Application, First Publication No. S61-139633 proposes that the amount of nitrogen present in a Ni-base alloy is set to be equal to or less than 0.01 mass %. The reason for this is considered to be as follows: a titanium nitride and other harmful nitrides tend to be formed in the presence of nitrogen and these nitrides cause fatigue cracks.

Japanese Unexamined Patent Application, First Publication No. 2009-185352 proposes that carbides and nitrides have a maximum particle diameter of 10 μm or less. It is pointed out that in the case where the particle diameter is equal to or greater than 10 μm, cracks occur from interfaces between the carbides and matrix phases and interfaces between nitrides and matrix phases during processing at room temperature.

In addition, in the iron and steel field, as shown in Japanese Unexamined Patent Application, First Publication Nos. 2005-265544 and 2005-274401, a method is proposed which estimates and evaluates a maximum particle diameter of nonmetallic inclusions, especially, oxides in a Fe—Ni alloy such as Fe-36% Ni and Fe-42% Ni.

However, in Japanese Unexamined Patent Application, First Publication No. S61-139633, although the upper limit value of the nitrogen amount is regulated, it is not associated with the maximum particle diameter of the nitrides. Therefore, there is a problem in that even when the nitrogen amount is reduced, a Ni-base alloy which has sufficient fatigue strength cannot be stably obtained.

In addition, Japanese Unexamined Patent Application, First Publication No. 2009-185352 specifies that the carbides and the nitrides have a maximum particle diameter of 10 μm or less. However, since the Ni-base alloy is used for aircrafts and gas turbine components for power generation, the degree of cleanliness must be extremely high. Therefore, in fact, it is difficult to grasp the maximum particle diameter by observation of all the sites. In the examples of Japanese Unexamined Patent Application, First Publication No. 2009-185352, the particle diameters of the carbides are measured, and in this regard, it is suggested that it is difficult to grasp the maximum particle diameter of the nitrides. In addition, in order to predict the maximum particle diameter of the nitrides, the maximum nitride particle diameter distribution in a field of view measured in practice is important. However, in Japanese Unexamined Patent Application, First Publication No. 2009-185352, there is no description with regard to this; and therefore, an estimated maximum particle diameter of the nitrides cannot be predicted.

In Japanese Unexamined Patent Application, First Publication Nos. 2005-265544 and 2005-274401, in the Fe—Ni alloy in which a large amount of relatively large nonmetallic inclusions are precipitated, oxides which easily increase in particle diameter is set as a measurement target. It is very difficult to estimate the maximum particle diameter of the nitrides in order to improve the fatigue strength in the Ni-base alloy, and various examinations are required. In addition, in the Ni-base alloy, an oxygen amount and a nitrogen amount are reduced due to re-melting, vacuum melting, and the like. Therefore, in the Ni-base alloy, the number of nonmetallic inclusions and their sizes are smaller than those in a steel material. Furthermore, since the Ni-base alloy includes various phases, analysis of emission intensities and observation of the nonmetallic inclusions cannot be performed in the same manner as in the iron and steel fields.

Therefore, even in the case where the method which is performed in the iron and steel field is simply applied, a relationship between the nitrides in the Ni-base alloy and the fatigue strength cannot be sufficiently evaluated.

SUMMARY OF THE INVENTION

Problems to be Solved by the Invention

The invention is contrived in view of the above-described circumstances. The inventors of the invention obtained knowledge that a maximum particle diameter of nitrides in a Ni-base alloy has a great influence on fatigue strength. In addition, in fact, since it was difficult to observe all of target cross-sections, a relationship between an estimated nitride maximum size and fatigue strength in a target cross-sectional area for prediction was considered. The inventors of the invention completed the invention based on the above-described knowledge and results of the consideration. The invention aims to provide a Ni-base alloy which is excellent in mechanical properties, especially, fatigue strength.

Means for Solving the Problems

In order to solve the problem and achieve the object, a Ni-base alloy according to an aspect of the invention is provided in which an area-equivalent diameter D is calculated, and the area-equivalent diameter D is defined by $D=A^{1/2}$ from an area A of a largest nitride in a field of view when observation is performed for an observation area $S_0$ for measurement, this process is repeated in n fields of view for measurement, where n is the number of the fields of view for measurement, so as to acquire n pieces of data on the area-equivalent diameter D, and the pieces of data on the area-equivalent diameter D are arranged in ascending order of $D_1, D_2, \ldots, D_n$ to obtain a reduced variate $y_j$ which is defined by the following Expression (1).

[Formula 1]

$$y_j=-\ln[-\ln\{j/(n+1)\}] \quad (1)$$

(In the Expression (1), j is a rank number when the pieces of data on the area-equivalent diameter D are arranged in ascending order)

The obtained values are plotted on X-Y axis coordinates, where an X axis corresponds to the area-equivalent diameter D and a Y axis corresponds to the reduced variate $y_j$, a regression line $y_j=a\times D+b$ (a and b are constants) is obtained, and when a target cross-sectional area S for prediction is set to 100 $mm^2$, $y_j$ is obtained through the following Expression (2).

[Formula 2]

$$y_j = -\ln\left(-\ln\frac{S}{S_0+S}\right) \quad (2)$$

When the obtained value of $y_j$ is substituted into the regression line to calculate an estimated nitride maximum size, the estimated nitride maximum size is equal to or less than 25 μm in terms of area-equivalent diameter.

In the Ni-base alloy according to an aspect of the invention, the estimated nitride maximum size when the target cross-sectional area S for prediction is set to 100 $mm^2$ is equal to or less than 25 μm in terms of area-equivalent diameter; and therefore, nitrides having large sizes are not present in the Ni-base alloy. As a result, the mechanical properties of the Ni-base alloy can be improved.

In the nitride observation, the magnification is preferably in a range of 400 times to 1,000 times, and the number n of fields of view for measurement is preferably equal to or more than 30. In addition, in the measurement of the nitride area, it is preferable that first, a luminance distribution be acquired using image processing, a luminance boundary be determined to distinguish between a nitride, a matrix phase, a carbide, and the like, and then an area of the nitride be measured. At this time, a color difference (RGB) may be used in place of the luminance.

Here, the Ni-base alloy according to an aspect of the invention preferably contains 13 mass % to 30 mass % of Cr and 8 mass % or less of at least one of Al and Ti.

Since chrome (Cr) forms a favorable protective film and improves high-temperature corrosion resistance such as high-temperature oxidation resistance and high-temperature sulfidation resistance, Cr is desirably added. It is not desirable that the content of Cr be less than 13 mass % from the viewpoint of high-temperature corrosion resistance. In addition, it is not desirable that the content of Cr be greater than 30 mass % since harmful intermetallic compound phases tend to be precipitated.

In addition, aluminum (Al) and titanium (Ti) constitute a γ' phase ($Ni_3Al$) which is one of main precipitation strengthening phases, and act to improve high-temperature tensile properties, creep properties, and creep fatigue properties to thus lead to high-temperature strength. Therefore, either one or both of Al and Ti are desirably added. It is not desirable that the content of either one or both of Al and Ti be greater than 8 mass % from the viewpoint of a decline in hot workability.

Furthermore, in addition to the above-described Cr, Al, and Ti, 25 mass % or less of Fe may be contained.

Since iron (Fe) is inexpensive and economical and acts to improve hot workability, Fe is desirably added if necessary. The content of Fe is desirably 25 mass % or less from the viewpoint of high-temperature strength.

In addition, 0.01 mass % to 6 mass % of Ti may be contained.

The Ni-base alloy having such a composition is excellent in heat resistance and strength, and can be applied to parts which are used under a high-temperature environment such as aircrafts and gas turbines.

In addition, a titanium nitride is preferably measured as the nitride.

Since Ti is an active element, Ti easily generates a nitride. Since the titanium nitride has a polygonal shape, it has a great influence on mechanical properties even when its size is small. Accordingly, by evaluating the maximum size of the titanium nitride in the Ni-base alloy with high precision using the above-described method, the mechanical properties of the Ni-base alloy can be securely improved.

Effects of the Invention

According to an aspect of the invention, nitrides which are internally present are properly evaluated; and thereby, it is possible to provide a Ni-base alloy which is excellent in mechanical properties, especially, fatigue strength.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Hereinafter, a Ni-base alloy according to an embodiment of the invention will be described.

The Ni-base alloy according to this embodiment contains Cr: 13 mass % to 30 mass %, Fe: 25 mass % or less, and Ti: 0.01 mass % to 6 mass %, with the balance being Ni and unavoidable impurities.

In the Ni-base alloy according to this embodiment, an area-equivalent diameter D is calculated, and the area-equivalent diameter D is defined by $D=A^{1/2}$ from an area A of a largest nitride in a field of view when observation is performed for an observation area $S_0$ for measurement. This process is repeated in n fields of view for measurement, where n is the number of the fields of view for measurement, so as to acquire n pieces of data on the area-equivalent diameter D. These pieces of data on the area-equivalent diameter D are arranged in ascending order of $D_1$, $D_2$, . . . , $D_n$ to obtain a reduced variate $y_j$ which is defined by the following Expression (1).

[Formula 3]

$$y_j = -\ln[-\ln\{j/(n+1)\}] \quad (1)$$

(In the Expression (1), j is a rank number when the pieces of data on the area-equivalent diameter D are arranged in ascending order)

The obtained values are plotted on X-Y axis coordinates, where an X axis corresponds to the area-equivalent diameter D and a Y axis corresponds to the reduced variate $y_j$, and a regression line $y_j = a \times D + b$ (a and b are constants) is obtained. When a target cross-sectional area S for prediction is set to 100 $mm^2$, $y_j$ is obtained through the following Expression (2).

[Formula 4]

$$y_j = -\ln\left(-\ln\frac{S}{S_0 + S}\right) \quad (2)$$

When the obtained value of $y_j$ is substituted into the regression line to calculate an estimated nitride maximum size, the estimated nitride maximum size is equal to or less than 25 μm in terms of area-equivalent diameter.

In this embodiment, the nitride is mainly a titanium nitride.

Figure 1:
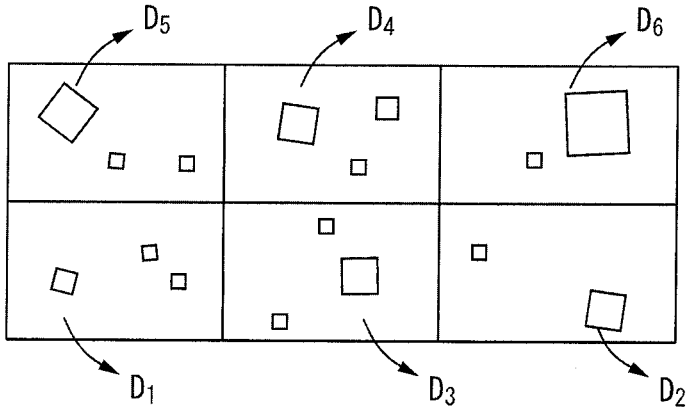
FIG. 1 is a diagram illustrating a procedure for extracting a nitride having a maximum size from a field of view for microscopic observation in a Ni-base alloy according to an embodiment.

Here, the above-described method of estimating the estimated nitride maximum size will be described with reference to FIGS. 1 and 2.

First, an observation area $S_0$ for measurement is set for observation with a microscope, and nitrides in the observation area $S_0$ for measurement are observed. At this time, the observation magnification is preferably set to be in a range of 400 times to 1,000 times. As shown in FIG. 1, a nitride having a maximum size is selected among the nitrides observed in the observation area $S_0$ for measurement. In order to measure the size with high precision, the selected nitride is observed at a higher magnification and an area A thereof is measured to calculate an area-equivalent diameter $D = A^{1/2}$. At this time, the observation magnification is preferably set to be in a range of 1,000 times to 3,000 times.

In the nitride observation, the magnification is preferably set to be in a range of 400 times to 1,000 times, and the number n of fields of view for measurement is preferably equal to or more than 30, and more preferably equal to or more than 50. In addition, in the measurement of the nitride area, it is preferable that first, a luminance distribution be acquired using image processing, a luminance boundary be determined to separate a nitride, a matrix phase, a carbide, and the like, and then an area of the nitride be measured. At this time, a color difference (RGB) may be used in place of the luminance. Particularly, in the case where a carbide such as the carbide shown in Japanese Unexamined Patent Application, First Publication No. S61-139633 is present, it may be difficult to be distinguished from the nitride only with the luminance. Therefore, the separation is more preferably performed with a color difference (RGB). In addition, the test piece provided for observation is observed with a scanning electron microscope, and analysis is performed using an energy dispersive X-ray analyzer (EDS) mounted on the scanning electron microscope. As a result, it is confirmed that the nitride is a titanium nitride.

This process is repeated in n fields of view for measurement, where n is the number of fields of view for measurement, so as to acquire n pieces of data on the area-equivalent diameter D. The n area-equivalent diameters D are arranged in ascending order to obtain data of $D_1, D_2, \ldots, D_n$.

Using the data of $D_1, D_2, \ldots, D_n$, a reduced variate yj which is defined by the following Expression (1) is obtained.

[Formula 5]

$$y_j = -\ln[-\ln\{j/(n+1)\}] \quad (1)$$

In the Expression (1), j is a rank number when the pieces of data on the area-equivalent diameter D are arranged in ascending order.

Figure 2:
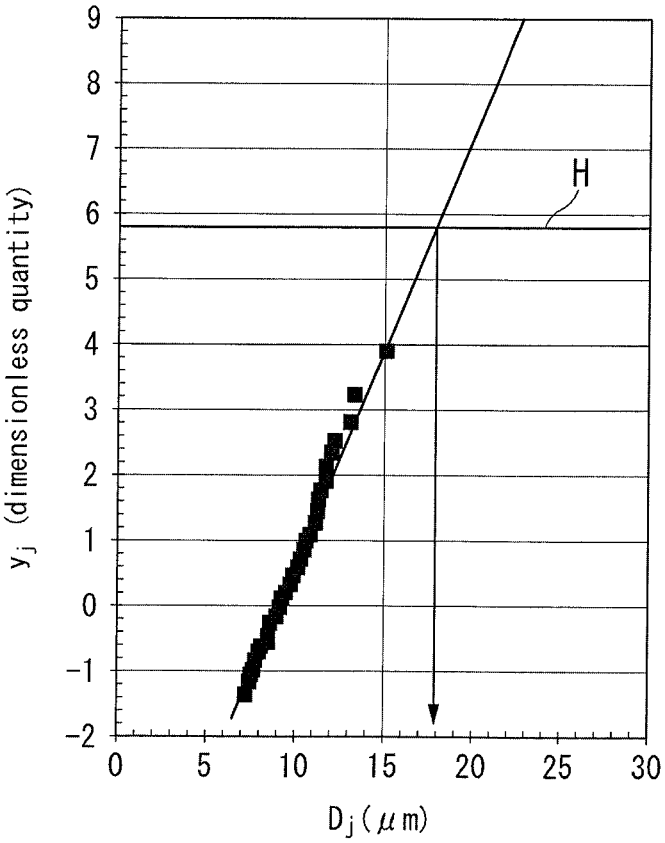
FIG. 2 is a graph showing results of plotting of area-equivalent diameters of nitrides and reduced variates on X-Y coordinates in the Ni-base alloy according to the embodiment.

Next, as shown in FIG. 2, the pieces of data are plotted on X-Y coordinates, where an X axis corresponds to the data of the n area-equivalent diameters $D_1, D_2, \ldots, D_n$, and a Y axis corresponds to values of reduced variates $y_1, y_2, \ldots, y_n$ corresponding to the data.

A regression line $y_j = a \times D_j + b$ (a and b are constants) is obtained by the plotting.

Next, an answer of $y_j$ is calculated through the following Expression (2). At this time, a target cross-sectional area S for prediction is set to 100 $mm^2$. That is, the value of $y_j$ corresponding to the target cross-sectional area S for prediction (=100 $mm^2$) is calculated from the Expression (2).

[Formula 6]

$$y_j = -\ln\left(-\ln\frac{S}{S_0 + S}\right) \quad (2)$$

In the graph shown in FIG. 2, the value of $D_j$ of the regression line at the value of $y_j$ corresponding to the target cross-sectional area S for prediction (the straight line H in FIG. 2) becomes an estimated nitride maximum size. In this embodiment, the estimated maximum size is equal to or less than 25 μm.

Hereinafter, an example of a method of manufacturing a Ni-base alloy according to this embodiment will be described.

Raw materials including elements other than Ti and Al are mixed and melted in a vacuum melting furnace. At this time, high-purity raw materials having a small nitrogen content are used as the raw materials of Ni, Cr, Fe, or the like.

Before the melting is started, the atmosphere in the furnace is repeatedly replaced three or more times with high-purity argon. Thereafter, vacuuming is performed, and the temperature in the furnace is raised. The molten metal is held for predetermined hours, and then Ti and Al which are active metals are added thereto, and the molten metal is held for predetermined hours. The molten metal is poured into a mold to obtain an ingot. From the viewpoint of preventing coarsening of nitrides, Ti is desirably added as immediately before pouring the molten metal into the mold as possible. The ingot is subjected to plastic working to manufacture a billet having no casting structure.

The Ni-base alloy manufactured through such a manufacturing method has a low nitrogen content. In addition, the time during Ti, which is an active element, is held at high temperature is short. Therefore, generation and growth of a titanium nitride can be suppressed. Accordingly, as described above, the estimated nitride (titanium nitride) maximum size when the target cross-sectional area S for prediction is set to 100 $mm^2$ is equal to or less than 25 μm.

According to the Ni-base alloy of this embodiment having the above-described properties, the estimated nitride maximum size when the target cross-sectional area S for prediction is set to 100 $mm^2$ is equal to or less than 25 μm in terms of area-equivalent diameter $D_j$. Therefore, nitrides having a large size are not present in the Ni-base alloy; and thereby, the mechanical properties of the Ni-base alloy can be improved.

Particularly, in this embodiment, Ti which is an active element is contained and the nitride is a titanium nitride. The titanium nitride has a polygonal cross-section. Therefore, it has a great influence on mechanical properties even when its size is small. Accordingly, by evaluating the maximum size of the titanium nitride in the Ni-base alloy with high precision using the above-described method, the mechanical properties of the Ni-base alloy can be securely improved.

Although the Ni-base alloy according to the embodiment of the invention has been described as above, the invention is not limited thereto, and appropriate modifications can be made without departing from the features of the invention.

For example, the Ni-base alloy has been described which has a composition including Cr: 13 mass % to 30 mass %, Fe: 25 mass % or less, and Ti: 0.01 mass % to 6 mass %, with the balance being Ni and unavoidable impurities; however, the invention is not limited thereto, Ni-base alloy having other compositions may be provided. For example, Al may be contained.

In addition, the Ni-base alloy manufacturing method is not limited to the method exemplified in this embodiment, and other manufacturing methods may be applied. As a result of the evaluation of the nitrides using the above-described method, the estimated nitride maximum size should be equal to or less than 25 μm in terms of area-equivalent diameter when the target cross sectional area S for prediction is set to 100 $mm^2$.

For example, a method may be employed which includes: bubbling the molten metal in the vacuum melting furnace with high-purity Ar gas so as to reduce the nitrogen content in the molten metal; and then adding an active element such as Ti.

In addition, a method may be employed which includes: reducing the pressure in the chamber of the vacuum melting furnace; introducing high-purity Ar gas into the chamber so as to make the chamber pressure positive to thus prevent incorporation of air; and in this state, adding and melting an active element such as Ti.

EXAMPLES

Hereinafter, results of a confirmation test performed to confirm the effects of the invention will be described.

Invention Examples A to E 10 kg of an alloy shown in Table 1 was melted in a vacuum melting furnace. First, acid-pickled raw materials such as Ni, Cr, Fe, Nb, Mo, and Co were charged in a crucible and subjected to high-frequency induction melting. At this time, the melting temperature was set to 1450° C. and a crucible made of high-purity MgO was used. The raw materials such as Ni, Cr, Fe, Nb, Mo, and Co were charged, and then before the melting was started, the atmosphere in the furnace was repeatedly replaced three or more times with high-purity argon. Thereafter, vacuuming was performed, and the temperature was raised in the furnace.

The addition of Ti and Al which were active elements was performed in the following two ways (i) and (ii).

(i) One half of the addition amount of Ti and Al, which were active elements, was charged in a crucible simultaneously with the raw materials such as Ni, Cr, Fe, Nb, Mo, and Co. In addition, the remaining half was added after 10 minutes passed from melt-down.

(ii) The total amount of Ti and Al was added after 10 minutes passed from melt-down of the raw materials.

The molten metal in which the component adjustment had been conducted was held for 3 minutes, and then the molten metal was poured into a cast-iron mold (ϕ80×250 H) to manufacture an ingot. This ingot was subjected to billet forging to provide plastic strain of 1.5 by cogging; and thereby, a billet having no casting structure was manufactured. In this case, the nitrogen content in the ingot was in a range of 50 ppm to 300 ppm.

Comparative Examples F and G 10 kg of an alloy shown in Table 1 was subjected to air melting in a high-frequency induction melting furnace. First, raw materials such as Ni, Cr, Fe, Nb, Mo, Co, Ti, and Al, which were not subjected to acid pickling, were charged in a crucible and melted. At this time, after the melting, the molten metal was held for 10 minutes at 1500° C., and then the molten metal was held for 10 minutes at 1450° C. A crucible made of high-purity MgO was used. Then, the molten metal was poured into a cast-iron mold (ϕ80×250 H) to manufacture an ingot. This ingot was subjected to billet forging to provide plastic strain of 1.5 by cogging; and thereby, a billet having no casting structure was manufactured. In this case, the nitrogen content in the ingot was in a range of 300 ppm to 500 ppm.

A sample for structure observation was cut out of the obtained billet, and the sample was polished and subjected to microscopic observation. An estimated nitride maximum size when a target cross-sectional area S for prediction was set to 100 $mm^2$ was calculated according to the above-described procedure. In this example, an observation area $S_0$ for measurement was set to 0.306 $mm^2$. The selection of the nitride having the maximum size in the observation area $S_0$ for measurement was performed by observation at a 450-fold magnification, and the area of the selected nitride was measured by observation at a 1,000-fold magnification. The number n of fields of view for measurement was 50.

Figure 3:
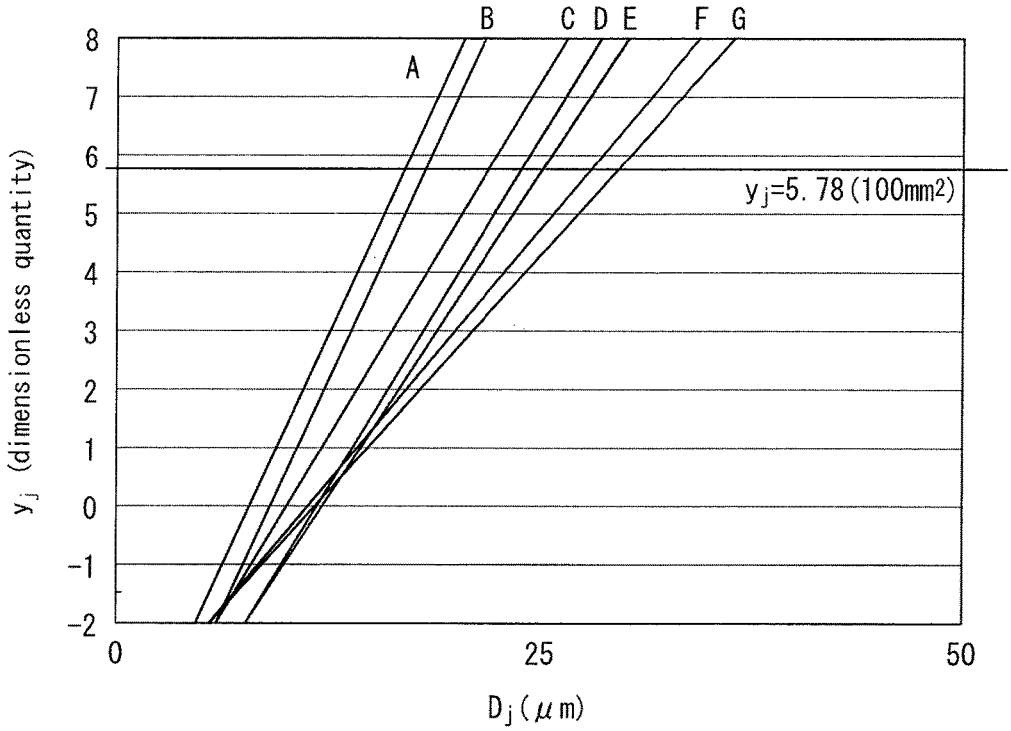
FIG. 3 is a graph showing results of plotting of area-equivalent diameters of nitrides and reduced variates on X-Y coordinates in example.

FIG. 3 shows regression lines obtained by plotting the data on the X-Y coordinates. Here, a reduced variate $y_j$ is 5.78 when a target cross-sectional area S for prediction is set to 100 $mm^2$ and an observation area $S_0$ for measurement is set to 0.306 $mm^2$. A value (area-equivalent diameter $D_j$) of the X-coordinate of an intersection between the straight line in which $y_j$ is 5.78 and a regression line is an estimated nitride maximum size. It is confirmed that in the invention examples A to E, the estimated nitride maximum sizes (area-equivalent diameters $D_j$) are equal to or less than 25 μm. In contrast, it is confirmed that in the comparative examples F and G, the estimated nitride maximum sizes (area-equivalent diameters Dj) are greater than 25 μm.

Next, a sample for measurement was cut out of the obtained billet, and a nitrogen content in the Ni-base alloy was measured. The sample was melted in inert gas, and the nitrogen content was measured through a heat conduction method. Since TiN was difficult to decompose, the measurement was performed by raising the temperature to 3,000° C.

In addition, a test piece was prepared from the obtained billet to evaluate fatigue strength through low-cycle fatigue test. The low-cycle fatigue test was performed according to ASTM E606 under conditions where the atmosphere temperature was 600° C., the maximum strain was 0.94%, the stress ratio (minimum stress/maximum stress) was 0, and the frequency was 0.5 Hz to measure the number of times of failure (the number of repetitions of the testing cycle up to the failure). The fatigue strength was evaluated from the number of times of failure. The surface of the test piece was subjected to machining, and then polished to be finished.

The evaluation results are shown in Table 1.

TABLE 1

| | Alloy Type | Nominal Component Composition | Method of Adding Ti and Al | Estimated Nitride Maximum Size (μm) | Number of Times of Failure (times) |
|---|---|---|---|---|---|
| Invention Example A | UNS No. 7718 | Ni-19 wt % Cr-18 wt % Fe-5.1 wt % Nb-3 wt % Mo-0.9 wt % Ti-0.5 wt % Al | The total amount was added after 10 minutes passed from melt-down. | 16 | $5.1 \times 10^4$ |
| Invention Example B | UNS No. 7001 | Ni-20 wt % Cr-14 wt % Co-4 wt % Mo-3 wt % Ti-1 wt % Al | The total amount was added after 10 minutes passed from melt-down. | 17 | $1.0 \times 10^4$ |
| Invention Example C | UNS No. 7718 | Ni-19 wt % Cr-18 wt % Fe-5.1 wt % Nb-3 wt % Mo-0.9 wt % Ti-0.5 wt % Al | One half of the total amount was added when raw materials were charged before melting. The remaining half was added after 10 minutes passed from melt-down. | 21 | $3.2 \times 10^4$ |
| Invention Example D | UNS No. 7718 | Ni-19 wt % Cr-18 wt % Fe-5.1 wt % Nb-3 wt % Mo-0.9 wt % Ti-0.5 wt % Al | The total amount was added after 10 minutes passed from melt-down. | 24 | $2.4 \times 10^4$ |
| Invention Example E | UNS No. 7718 | Ni-19 wt % Cr-18 wt % Fe-5.1 wt % Nb-3 wt % Mo-0.9 wt % Ti-0.5 wt % Al | One half of the total amount was added when raw materials were charged before melting. The remaining half was added after 10 minutes passed from melt-down. | 25 | $3.1 \times 10^4$ |
| Comparative Example F | UNS No. 7718 | Ni-19 wt % Cr-18 wt % Fe-5.1 wt % Nb-3 wt % Mo-0.9 wt % Ti-0.5 wt % Al | The total amount was added when raw materials were charged before melting. | 28 | $5.6 \times 10^3$ |
| Comparative Example G | UNS No. 7001 | Ni-20 wt % Cr-14 wt % Co-4 wt % Mo-3 wt % Ti-1 wt % Al | The total amount was added when raw materials were charged before melting. | 29 | $3.8 \times 10^3$ |

In the comparative examples F and G in which the estimated nitride maximum size when the target cross-sectional area S for prediction was set to 100 $mm^2$ was greater than 25 μm in terms of area-equivalent diameter, the number of times of failure was small; and therefore, the fatigue strength was confirmed to be low.

In contrast, in the invention examples A to E in which the estimated nitride maximum size when the target cross-sectional area S for prediction was set to 100 $mm^2$ was 25 μm or less in terms of area-equivalent diameter, the fatigue strength was confirmed to be significantly improved.

INDUSTRIAL APPLICABILITY

A Ni-base alloy according to an aspect of the invention is excellent in mechanical properties, especially, fatigue strength. Therefore, the Ni-base alloy according to an aspect of the invention is suitable as a material of parts such as blades, vanes, disks, cases, combustors, and the like of aircrafts and gas turbines.

The invention claimed is:

1. A cast and plastically-worked Ni-base alloy comprising:

13 mass % to 30 mass % of Cr;

0.01 mass % to 6 mass % of Ti;

8 mass % or less of Al; and 25 mass % or less of Fe, wherein nitrides are present, and an area-equivalent diameter D is calculated, and the area-equivalent diameter D is defined by $D=A^{1/2}$ from an area A of a largest nitride in a field of view when observation is performed at a magnification of 400 times to 3000 times for an observation area $S_0$ for measurement, this process is repeated in n fields of view for measurement, where n is the number of the fields of view for measurement, so as to acquire n pieces of data on the area-equivalent diameter D, and the pieces of data on the area-equivalent diameter D are arranged in ascending order of $D_1, D_2, \ldots, D_n$ to obtain a reduced variate $y_j$ which is defined by the following Expression (1):

[Formula 1]

$$y_j=-\ln[-\ln\{j/(n+1)\}] \quad (1)$$

(in the Expression (1), j is a rank number when the pieces of data on the area-equivalent diameter D are arranged in ascending order), the obtained values are plotted on X-Y axis coordinates, where an X axis corresponds to the area-equivalent diameter D and a Y axis corresponds to the reduced variate $y_j$, a regression line $y_j=a\times D+b$ (a and b are constants) is obtained, and when a target cross-sectional area S for prediction is set to 100 $mm^2$, $y_j$ is obtained through the following Expression (2):

[Formula 2]

$$y_j = -\ln\left(-\ln\frac{S}{S_0+S}\right), \quad (2)$$

and when the obtained value of $y_j$ is substituted into the regression line to calculate an estimated nitride maximum size, the estimated nitride maximum size is equal to or less than 25 μm in terms of area-equivalent diameter.

2. The cast and plastically-worked Ni-base alloy according to claim 1, wherein the nitride is a titanium nitride.

* * * * *